US006521875B1

(12) United States Patent
Kim et al.

(10) Patent No.: US 6,521,875 B1
(45) Date of Patent: Feb. 18, 2003

(54) MICROWAVE OVEN HAVING A CONDUCTING MEMBER FOR CONTROLLING THE SUPPLY OF ELECTRICAL POWER

(75) Inventors: Chul Kim, Anyang (KR); Yong-woon Han, Kunpo (KR); Seong-deog Jang, Suwon (KR); Han-jun Sung, Seoul (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/831,163

(22) PCT Filed: Jan. 4, 1999

(86) PCT No.: PCT/KR99/00002

§ 371 (c)(1),
(2), (4) Date: May 7, 2001

(87) PCT Pub. No.: WO00/28788

PCT Pub. Date: May 18, 2000

(30) Foreign Application Priority Data

Nov. 11, 1998 (KR) ..... 98-48171

(51) Int. Cl.[7] ..... H05B 6/68
(52) U.S. Cl. ..... 219/715; 219/702
(58) Field of Search ..... 219/715, 702, 219/723, 724, 717, 756

(56) References Cited

U.S. PATENT DOCUMENTS 3,777,098 A * 12/1973 Tapper ..... 219/724
RE30,248 E 4/1980 Fritts
4,904,837 A * 2/1990 Low et al. ..... 219/717
5,237,140 A * 8/1993 Akazawa et al. ..... 219/717
5,331,128 A 7/1994 Koh
6,300,610 B1 * 10/2001 Han et al. ..... 219/722

FOREIGN PATENT DOCUMENTS

DE 4143366 6/1995
GB 2216688 10/1989

* cited by examiner

*Primary Examiner*—Teresa Walberg
*Assistant Examiner*—Quang Van
(74) *Attorney, Agent, or Firm*—Robert E. Bushnell, Esq.

(57) ABSTRACT

A microwave oven includes a pair of terminal members for connecting between a power source and a high voltage transformer, respectively. The terminal members are isolated electrically from each other by means of remote-locating, respectively. A conducting member is installed in the door, and both ends thereof are revealed on the one side of the door. The pair of terminal members contact with ends of the conducting member when the door is closed. Then, the supply of current supplied from electrical power to the high voltage transformer is controlled. Accordingly, the structure of the microwave oven is simplified. The AC/DC type microwave oven is capable of being prevented from encountering faulty switching operations according to large amounts of direct current when the DC input power source is used.

18 Claims, 7 Drawing Sheets

MICROWAVE OVEN HAVING A CONDUCTING MEMBER FOR CONTROLLING THE SUPPLY OF ELECTRICAL POWER

TECHNICAL FIELD

The present invention relates to a microwave oven, and more particularly to a microwave oven having a conducting member for controlling the supply of electrical power, which is capable of simplifying a structure of the switching system, according to controlling the electrical power supplied to a high voltage transformer by using a conducting member installed in a door.

BACKGROUND ART

FIG. 1 shows a microwave oven for heating/cooking food using microwaves. The microwave oven contains a case 20 for forming a cooking chamber 22, a door 21 for opening/closing the cooking chamber 22, a tray 24 being installed in the cooking chamber 22, and a panel 25 for controlling operations of the microwave oven.

FIG. 2 is a partial cutaway view of FIG. 1. A pair of latch hooks 28*a*, 28*b* are installed in the door 21, catch openings 27*a*, 27*b* are formed corresponding to each latch hook 28*a*, 28*b* at a front plate 26 of the case 20. If the door 21 is pushed shut, the latch hooks 28*a*, 28*b* will engage the catch openings 27*a*, 27*b* to hold the door 21 shut.

At the back side of the panel 25 is provided a device chamber (not shown). In the device chamber are installed a magnetron for generating microwaves and a high voltage transformer HVT for generating a high voltage supplied to the magnetron, and so on. In supplying an AC power to the high voltage transformer HVT, this high voltage transformer HVT generates a predetermined high voltage to drive the magnetron. Then, the magnetron radiates microwaves of about 2,450 MHz frequency to heat/cook food.

As shown in FIG. 2, micro switches MS1, MS2, MS3 are installed at the back side of the front plate 26 of the case 20. FIGS. 3*a* and 3*b* are schematic diagrams and symbols of each micro switch MS1, MS2, MS3, respectively. The micro switches MS1, MS2, MS3 have a slight interval at the point of contact, and a mechanism of a snap action. The micro switches MS1, MS2, MS3 have a mechanism at the point of contact to open/close by the determined operation and force in a sealing case, and is a small switch for arranging a pushing mechanism of the actuator switch located on the outside of the case. That is, the micro switch is one of the contact type detectors, which detects something contacted according to releasing the inside point of contact when something 6 closes to a push button 1, and begins to push the push button 1, and applies more than a predetermined force F to the push button 1. In FIG. 3*a*, the reference numeral 2 is a movable spring, and the reference numeral 3 is a movable point of contact. The reference numeral 4 is a fixed point b of contact, and the reference numeral 5 is a fixed point a of contact. COM, NO, and NC are a common terminal, a normally open terminal, and a normally closed terminal, respectively. In FIG. 3*b*, a point a of contact 7 is the point of contact which conducts first when the micro switch is operated, and which connects the common terminal COM into the normally open terminal NO. A point b of contact 8 is the point of contact which conducts when the micro switch is not operated, and which connects the common terminal COM into the normally close terminal NC.

The micro switches MS1, MS2, MS3 each have an operating button 31, 32, 33, respectively. At the back side of the front plate 26 are installed a pair of movable members 29*a*, 29*b* to adjoin the catch openings 27*a*, 27*b*. Then, the movable members 29*a*, 29*b* are fixed for pivoting by each pin 23*a*, 23*b*, and are fixed elastically by each spring 41*a*, 41*b*.

In FIG. 2, if the door 21 is pushed closed, the micro switches MS1, MS2, MS3 are operated by the latch hooks 28*a*, 28*b* which are inserted in the catch openings 27*a*, 27*b*. That is, when the movable members 29*a*, 29*b* are pushed by each latch hook 28*a*, 28*b*, the movable members 29*a*, 29*b* are rotated against the elasticity of the springs 41*a*, 41*b*. Therefore, the operating button 31 is pushed by the upper movable members 29*a*, and the operating buttons 32, 33 are pushed by the lower movable members 29*a*, respectively.

Meanwhile, since the conventional microwave oven has been made to be operated using the AC common power source of 110V/220V for supplying high alternating current, the microwave oven cannot be used in a place where alternating current is not available.

To overcome the above described problem, an AC/DC type microwave oven has been developed, as shown in FIG. 4. In FIG. 4, an AC/DC type microwave oven includes an AC driving load 30, a DC driving load and DC/AC converting part 40, and a microwave oscillator 50. The AC driving load 30 is driven by an AC input power. The DC driving load and DC/AC converting part 40 includes the DC driving load being driven by a DC input power, and the DC/AC converter converting the DC input power into an AC power. The microwave oscillator 50 is supplied by only one of the AC input power or the DC/AC power converted by a DC/AC converter, and generates microwaves.

The AC driving load 30 is driven by alternating current, which includes a lamp and a fan motor, etc., which are connected to the AC power source. A power switch (not shown) to determine the supplying status of AC is connected to the AC power source. The DC driving load being driven by direct current, which includes a lamp and a fan motor, etc., which are connected to the DC power source. A power switch (not shown) to determine the supplying status of DC is connected to the DC power source. The direct current forms a differential DC circuit net discriminated as an AC circuit net. Then, the direct current is connected to the input side of the DC/AC converting part 40 which supplies alternating current. The microwave oscillator 50 includes a high voltage transformer HVT which receives the AC power, a high voltage condenser HVC, a high voltage diode HVD, and a magnetron MGT. The operation of the microwave oscillator 50 is described the same way as shown in FIG. 1.

Therefore, as the AC power source supplies alternating current to the AC driving load 30, and as the DC power source supplies direct current to the DC driving load and DC/AC converting part 40, respectively, the conventional AC/DC type microwave oven is operated.

That is, in case the large amount of current is supplied through the micro switches MS1, MS2, the points of contact of the micro switches MS1, MS2 can remain in the contacting status. When the user pulls the door 21 so that the cooking chamber is open, the operating buttons 31, 32 of the micro switches MS1, MS2 can remain in the pushed status. Accordingly, as the primary switch PC and secondary switch SD of the DC driving load and DC/AC converting part 40 are held in the closed status, current is supplied to the DC driving load and DC/AC converting part 40, so the AC/DC type microwave oven has the problem of encountering a malfunction.

According as the primary switch PC and secondary switch SD of the DC driving load and DC/AC converting part 40 are held there closed status, and then current is supplied to the DC driving load and DC/AC converting part 40, so the AC/DC type microwave oven has the problem of encountering a malfunction.

FIG. 5 is a block diagram of a conventional AC/DC type microwave oven operated by many micro switches. For preventing the threat of electromagnetic waves, the microwave oven is capable of isolating the supply of the power not to generate electromagnetic waves when the door 21 is open. For insuring the isolation of the supply of power, the microwave oven includes many micro switches PA, SA, MA, PD, SD, MD for multi-switching operations.

The structure of the microwave oven, however, becomes very complicated by many micro switches PA, SA, MA, PD, SD, MD, and by the peripheral parts for driving the micro switches. Furthermore, as the number of parts of the microwave increases, the manufacturing cost of the microwave oven increases.

SUMMARY OF THE INVENTION

The present invention has been made to overcome the above described problem of the prior art, and accordingly it is the first objective of the present invention to provide a microwave oven for simplifying the structure by operating multi-switching using a more simplified structure of a switching system.

It is the second objective of the present invention to provide an AC/DC type microwave oven for preventing faulty switching operations by large amounts of current when the DC input power source is used.

To achieve the above objectives, the present invention provides a microwave oven having a conducting member for controlling the supply of electrical power. In a microwave oven having a case forming a cooking chamber, a door for opening/closing the chamber, a high voltage transformer for generating a high voltage, and a magnetron for generating microwaves driven by the high voltage being output from the high voltage transformer, the microwave oven includes: a pair of terminal members being connected between an electrical power source and the high voltage transformer, in which the terminal members are remote-located, respectively; and a conducting member for being installed in the door to reveal the ends of the conducting member on one side of the door, and for being connected electrically to the terminal members as the ends of the conducting member are contacted to the terminal members, respectively.

A pair of latch hooks is formed in the door, and a pair of catch openings into which the latch hooks are inserted is formed at the front of the case; the ends of the conducting members are contacted to the terminal members when the latch hooks are inserted into the catch openings, accordingly, as the ends of the conducting member are revealed at one end of the latch hooks.

According to the embodiment of the present invention, the electrical power source is a direct current power source for supplying direct current; and means for converting the direct current into alternating current intervenes between the direct current power source and the high voltage transformer.

The means for converting includes: a commutator containing a commutator case formed almost cylindrical in appearance and made of insulated materials, for containing one or more pair of conducting parts for being remote-contacted to the outer circle side of the commutator case at each determined interval; a motor for rotating the commutator; a pair of input brushes for applying the direct current to the commutator according to being contacted to the outer circle side of the commutator, respectively; and a pair of output brushes for converting/producing the direct current supplied by the input brushes into alternating current, when the commutator rotates according to being contacted to the outer circle side of the commutator, respectively.

To achieve the above objective, the present invention provides an AC/DC type microwave oven having a conducting member for controlling the supply of electrical power. In an AC/DC type microwave oven for supplying a microwave oscillator with direct current or alternating current, the AC/DC type microwave oven includes: a pair of terminal members being connected between the high voltage transformer and the AC or DC supply of electrical power, wherein the terminal members are remote-located, respectively; and a conducting member for being installed in a door to reveal ends of the conducting member on one side of the door, and for connecting electrically to the terminal members by contacting the ends of the conducting member to the terminal members, respectively, when the door is closed.

Accordingly, since the simplified structure of the microwave oven is supplied, the microwave oven can be prevented from encountering faulty switching operation generated by means of large amounts of current supplied from direct current when the DC input power source is used.

BRIEF DESCRIPTION OF THE DRAWINGS

The above objective and other advantages of the present invention will become more apparent by being described in detail in a preferred embodiment thereof with reference to the attached drawings, in which.

DETAILED DESCRIPTION OF THE INVENTION

Figure 1:
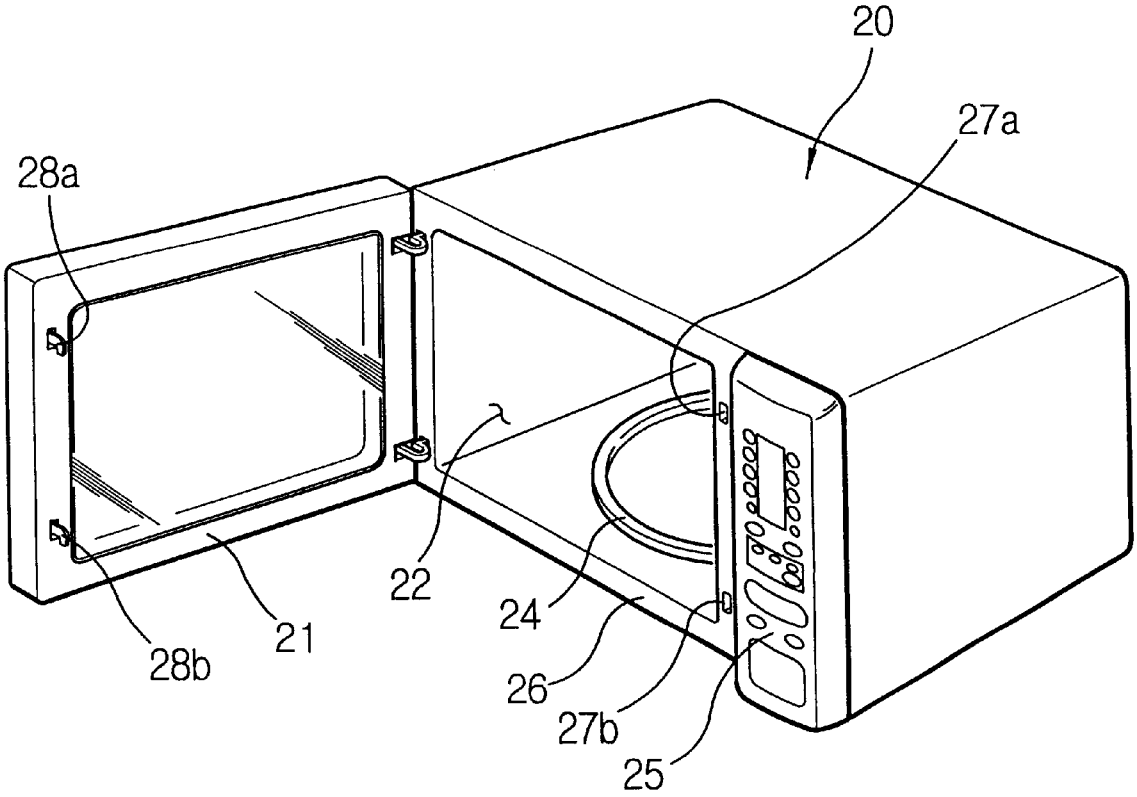
FIG. 1 (PRIOR ART)
FIG. 1 is a cutaway view of a conventional microwave oven.
Figure 2:
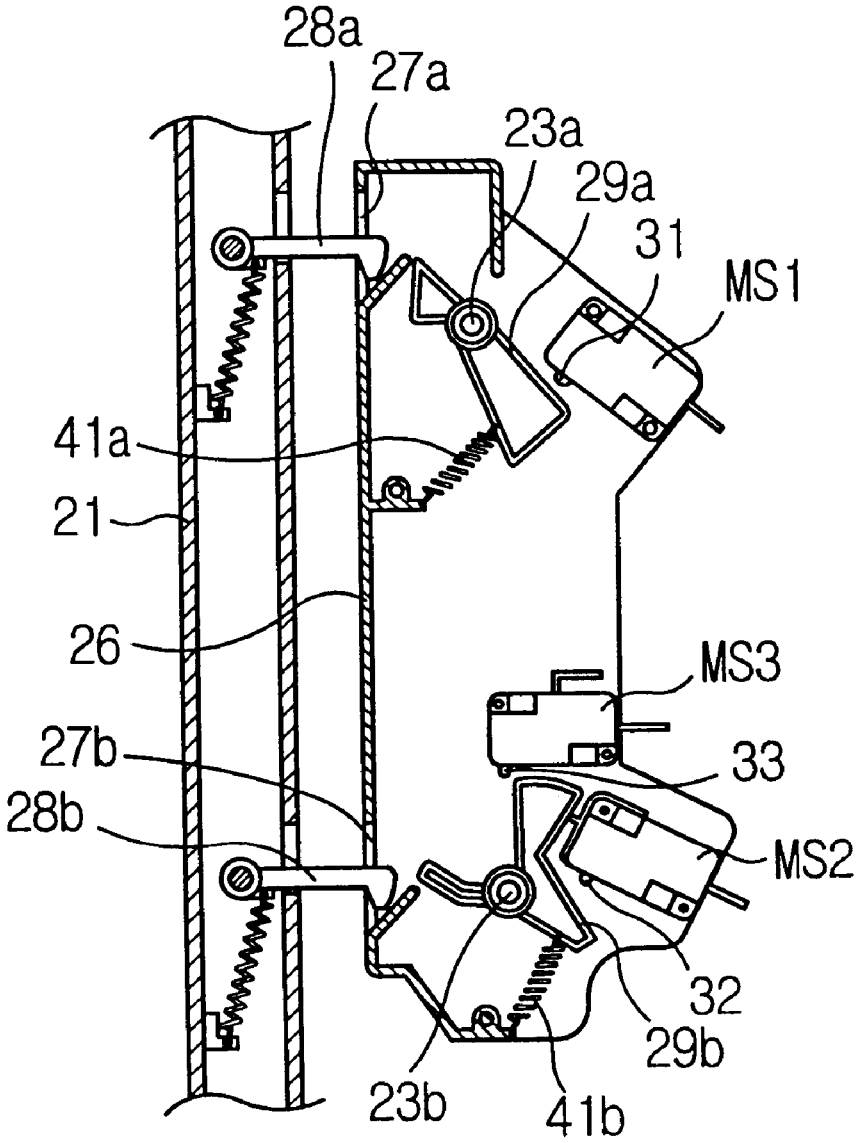
FIG.2 (PRIOR ART)
FIG. 2 is a partial cutaway view of FIG. 1 for explaining a micro switch and the operation of the opening/closing of the conventional microwave oven.
Figure 3A:
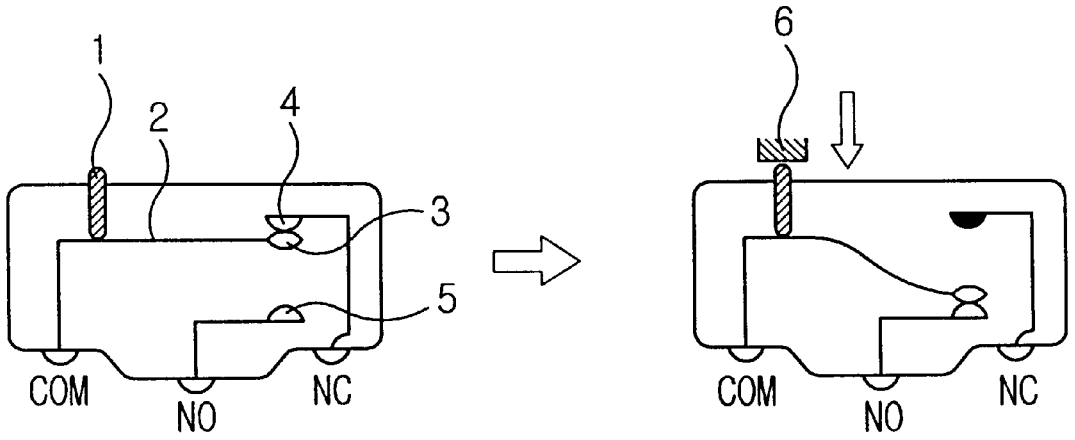
FIG.3a (PRIOR ART)
FIGS. 3*a* and 3*b* are a schematic diagram and symbols of the micro switch, respectively.
Figure 3B:
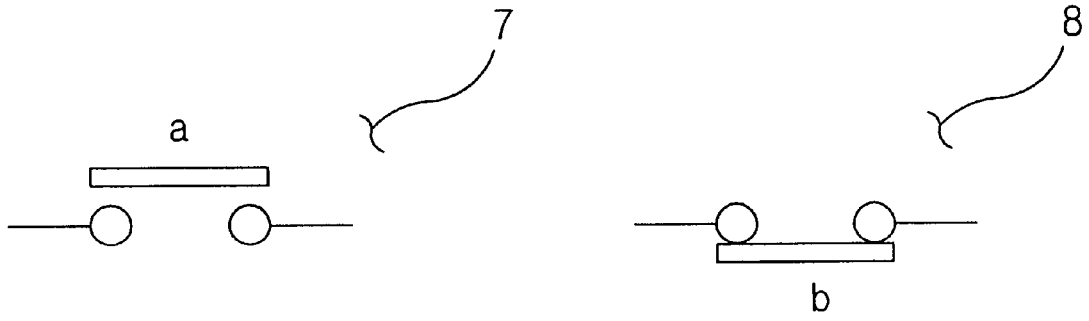
FIG.3b (PRIOR ART)
Figure 4:
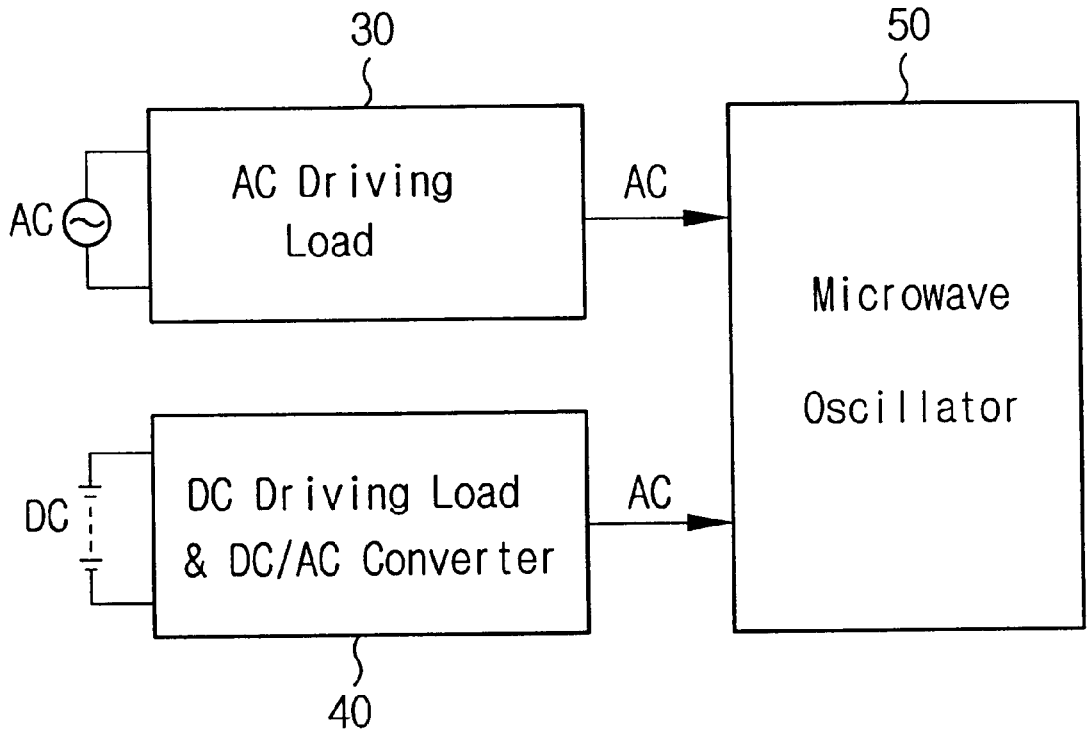
FIG.4 (PRIOR ART)
FIG. 4 is a block diagram of a conventional AC/DC type microwave oven.
Figure 5:
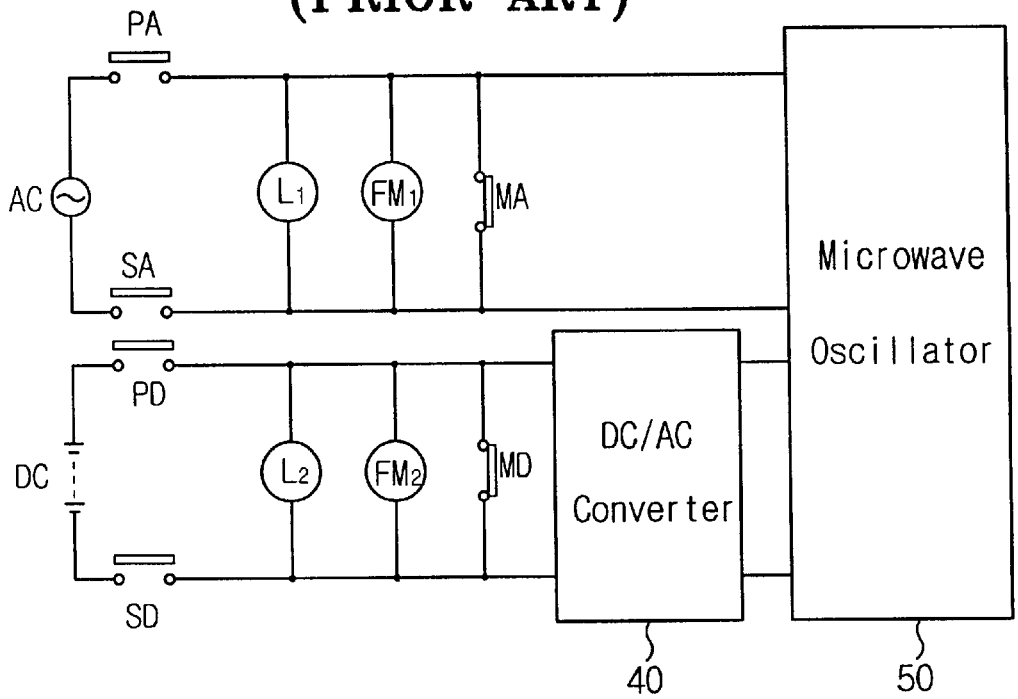
FIG.5 (PRIOR ART)
FIG. 5 is a schematic diagram of a conventional AC/DC type microwave oven operated by many micro switches.
Figure 6:
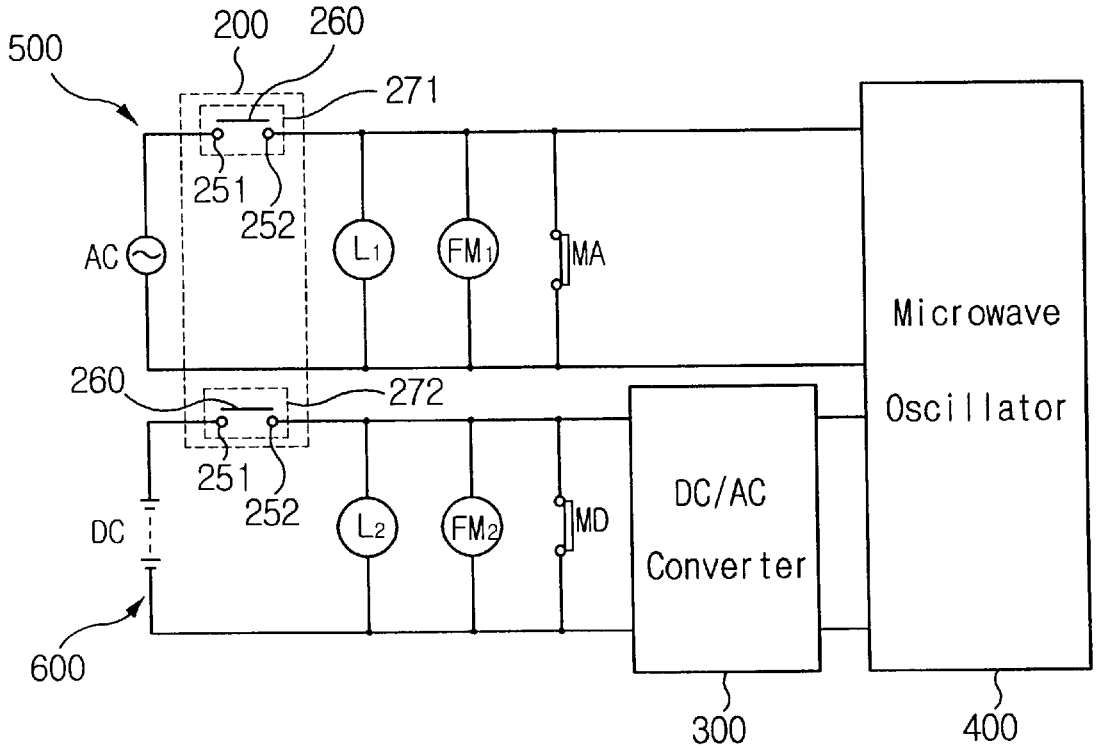
FIG. 6 is a block diagram of a microwave oven having a conducting member for controlling the supply of the electrical power according to the present invention.

FIG. 6 is a block diagram of a microwave oven having a conducting member for controlling the supply of electrical power according to the present invention. This microwave oven includes a switch 200 that includes a main switch 271 instead of the micro switches PA, SA of the AC circuit part and a main switch 272 instead of the micro switches PD, SD of the DC circuit part.

Figure 7:
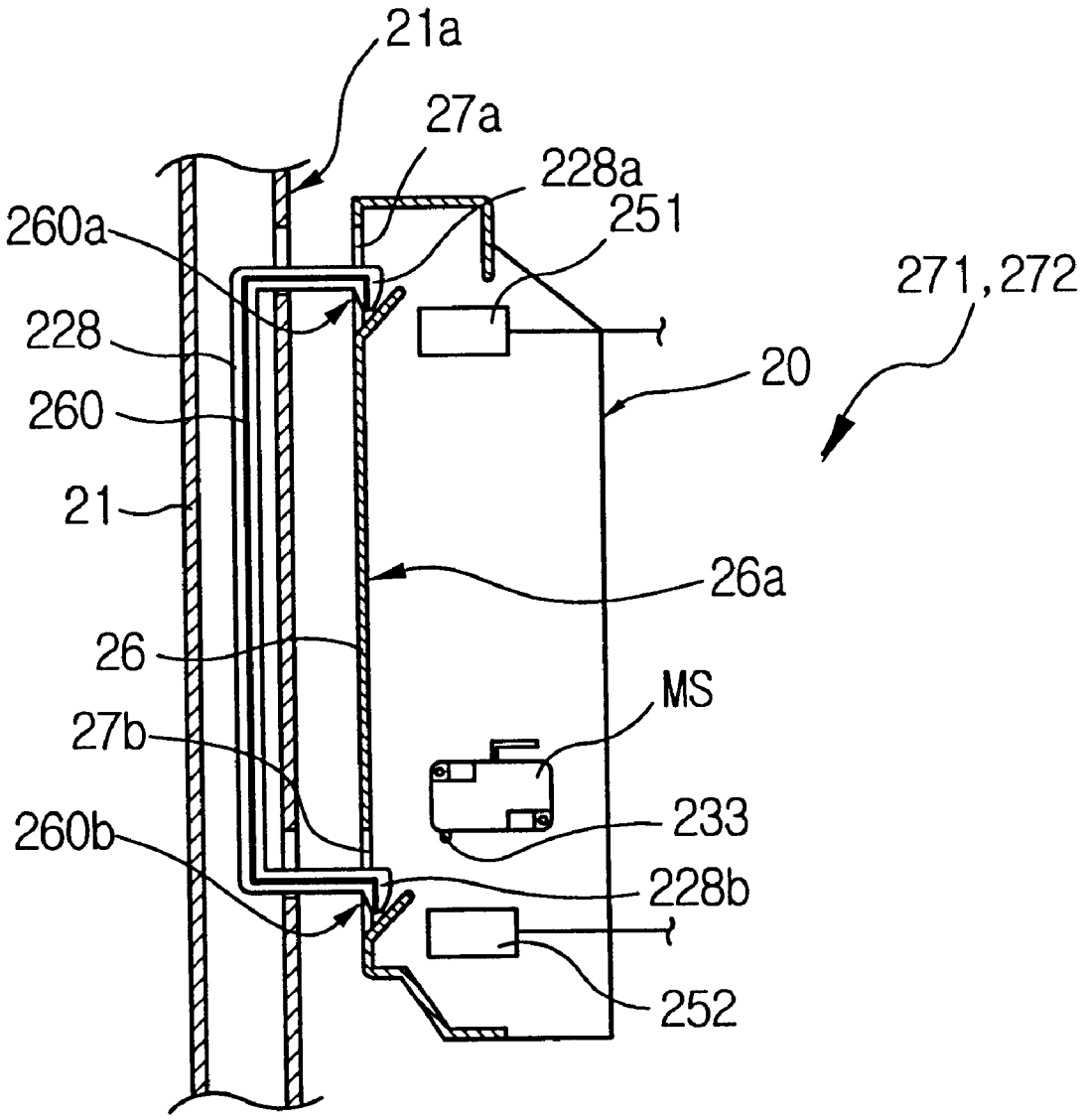
FIG. 7 is a partial cutaway view of a microwave oven having a conducting member for controlling the supply of the electrical power according to the present invention.
Figure 8:
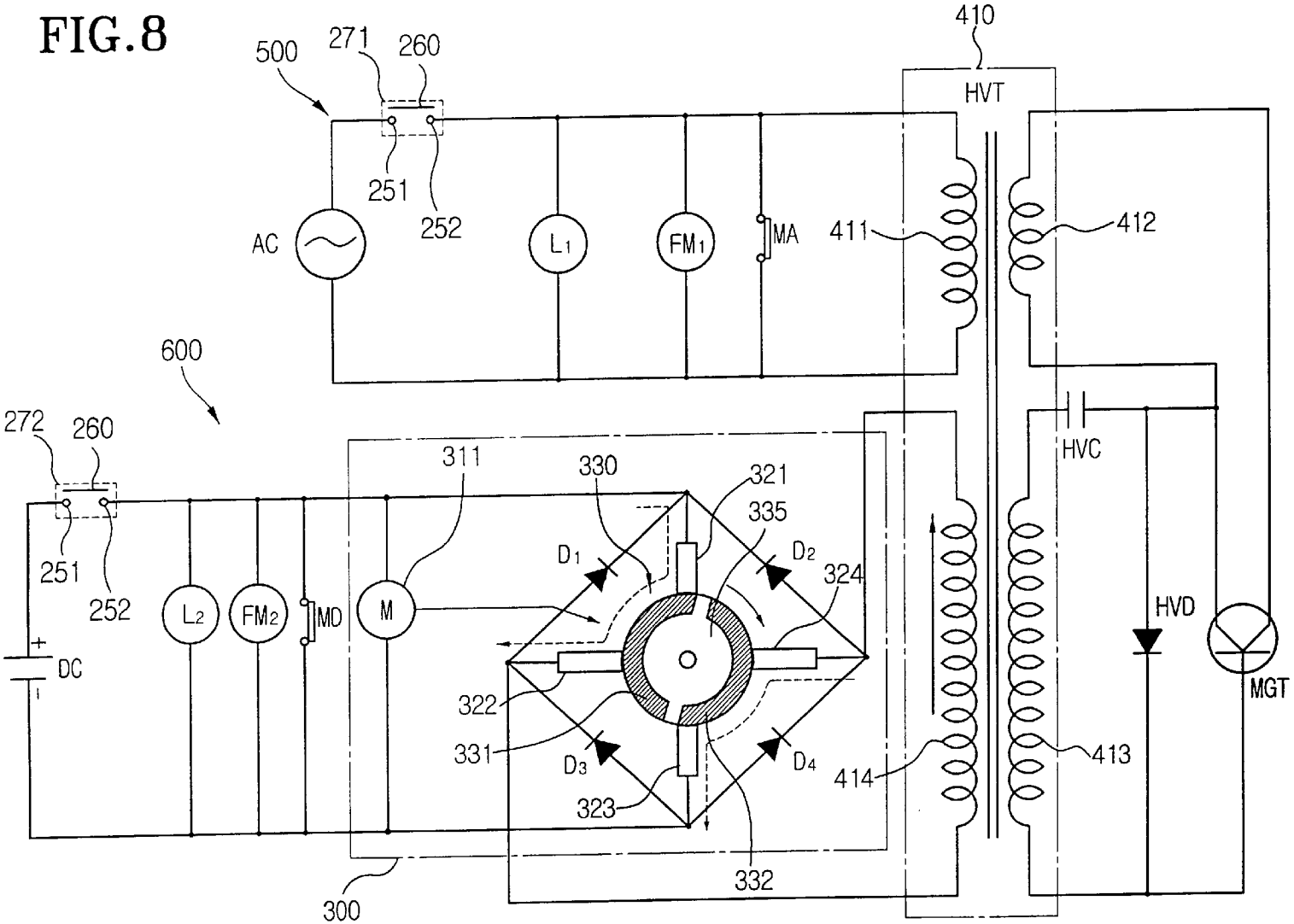
FIG. 8 is a schematic diagram of a microwave oven having a conducting member for controlling the supply of the electrical power according to the present invention.

FIG. 7 is a partial cutaway view of a microwave oven having a conducting member for controlling the supply of electrical power, and FIG. 8 is a schematic diagram of a microwave oven. The microwave oven includes an AC circuit part 500, a DC circuit part 600, and a microwave oscillating part 400. The AC circuit part 500 supplies a high voltage transformer 410 with alternating current by an AC input power source, and the DC circuit part 600 supplies to the high voltage transformer 410 which converts alternating current after converting direct current supplied by a DC input power source into alternating current, and the microwave oscillating part 400 generates microwaves by means of the outputting voltage of the high voltage transformer 410.

With reference to FIG. 8, an AC/DC type microwave oven includes; an AC circuit part 500 being driven by AC input power source; a DC circuit part 600 being driven by DC input power source; a high voltage transformer 410 being driven by the AC circuit part 500 or the DC circuit part 600; a high voltage condenser HVC and a high voltage diode HVD for doubling the output voltage of the high voltage transformer 410; and a magnetron MGT for generating microwaves by means of being driven by the doubled voltage.

The high voltage transformer 410 contains many coils 411, 412, 413, 414, and is driven by the AC circuit part 500 or the DC circuit part 600 to generate a high voltage of about 2,000V.

If the main switch 271 is switched on and the monitor switch MA is switched off, the first lamp $L_1$ and the first fan motor $FM_1$ are driven, and an AC input power source supplies alternating current to the high voltage transformer 410 simultaneously. Then, the high voltage transformer 410 generates a high voltage, and a magnetron MGT generates microwaves by means of the high voltage.

The DC circuit part 600 contains the second lamp $L_2$, the second fan motor $FM_2$, a DC/AC converter 300 for converting direct current supplied by DC input power source into alternating current, and a main switch 272 along with a monitor switch MD for controlling DC power.

The DC/AC converter 300 contains a commutator 330 including an outer circle 331, 332, a hub 335 and diodes $D_1$, $D_2$, $D_3$, $D_4$, a commutator motor M 311 for rotating the commutator 330, and two pairs of brushes 321, 322, 323, 324 being contacted to the outer circle 331, 332 of the commutator 330. Two pairs of brushes 321, 322, 323, 324 are made of a pair of input brushes 321, 323 being connected to direct current, and a pair of output brushes 322, 324 being connected to the high voltage transformer 410. The pair of input brushes 321, 323 is contacted to the outer circle 331, 332 of the commutator 330, and supplies direct current to the commutator 330. The pair of output brushes 322, 324 is contacted to the outer circle 331, 332 of the commutator 330 and supplies to the high voltage transformer HVT 410 alternating current converted from direct current supplied by the input brushes 321, 323, when the commutator 330 is rotated.

If the main switch 272 is switched on and the monitor switch MD is switched off, the second lamp $L_2$ and the second fan motor $FM_2$ are driven, and the commutator motor M 311 operates to rotate the commutator 330. As the commutator 330 is rotated, alternating current is supplied by means of output bushes 322, 324, and the high voltage transformer HVT 410 supplies a high voltage by means of this alternating current. Then, the high voltage transformer HVT 410 generates a high voltage, and a magnetron MGT generates microwaves by means of the high voltage.

With reference to FIGS. 7 and 8, each main switch 271, 272 contains a pair of terminal members 251, 252, and a conducting member 260.

The first terminal member 251 for respective main switches 271, 272 is connected to the AC input power source and the DC input power source, respectively, and the second terminal member 252 for the respective main switches 271, 272 is connected to the high voltage transformer HVT 410 or coupled to the high voltage transformer HVT 410 through the DC/AC converter 300. Each first terminal member 251 and each second terminal member 252 are arranged to respectively adjoin corresponding catch openings 27*a*, 27*b* at the back side 26*a* of the front plate 26 of the case 20, respectively.

In the door 21 is installed a hooking member 228, the hooking member 228 contains latch hooks 228*a*, 228*b* projected from an inside 21*a* of the door 21 at both ends of the hooking member 228. The conducting member 260 is arranged in a lengthwise direction in the hooking member 228, and both ends 260*a*, 260*b* of the conducting member 260 are revealed through the latch hooks 228*a*, 228*b* at the door 21.

If the door 21 is pushed closed, the latch hooks 228*a*, 228*b* are inserted into the case 20 through the catch openings 27*a*, 27*b*, and then both ends 260*a*, 260*b* of the conducting member 260 are contacted to the corresponding first terminal member 251 and the second terminal member 252, respectively. Accordingly, the first terminal member 251 and the second terminal member 252 are connected electrically with each other by means of the conducting member 260.

Meanwhile, at the upper side of the second terminal member 252 in the case 20 is installed a micro switch MS for driving the monitor switches MA, MD. The micro switch MS contains an operating button 233. If the door 21 is pushed closed, the operating button 233 is pushed by the side of the corresponding latch hook of latch hooks 228*a*, 228*b* being inserted through the catch openings 27*a*, 27*b*, and then the micro switch MS is pushed to open the monitor switches MA, MD.

Accordingly, when the door 21 is closed as above-described, alternating current or direct current is supplied to the AC circuit part 500 or the DC circuit part 600 by means of the AC input power source or the DC input power source, respectively, and then the microwave oven operates for the heating/cooking of food.

If any one of both ends 260*a*, 260*b* of the conducting member 260 is isolated from the corresponding terminal members 251, 252 according to the present invention, the supply of electrical power is isolated. As double switching is operated by one conducting member 260, the structure of the microwave oven is simplified.

As shown in the embodiment, the embodiment according to the present invention is adopted to the AC/DC type microwave oven having the conducting member 260 and the terminal members 251, 252 capable of using both alternating current and direct current. The present invention, however, is capable of being adopted to a conventional microwave oven being driven by only alternating current. If the present invention is adopted to a microwave oven capable of being driven by using direct current from an automobile battery, the holding of the previous status in the point of contact by means of large amounts of current is not operated since the micro switches are not used. Then, the faulty operations of the microwave oven are not encountered.

According to the present invention, the microwave oven is capable of heating/cooking food by means of using both alternating current and direct current. Besides, the microwave oven for operating selectively the AC circuit part 500 or the DC circuit part 600 has a differentiated selecting switch (not shown).

As above-described, the structure of the microwave oven according to the present invention is simplified since double switching is operated by the main switch with a simplified structure. Furthermore, the AC/DC type microwave oven is capable of being prevented from faulty switching operations caused by large amounts of direct current when the DC input power source is used.

While the present invention has been particularly shown and described with reference to the preferred embodiment thereof, it will be understood by those skilled in the art that various changes in form and details may be affected therein without departing from the spirit and scope of the invention as defined by the appended claims.

What is claimed is:

1. A microwave oven, comprising:

a case for forming a cooking chamber in said microwave oven;

a door for selectively opening and closing said cooking chamber;

a high voltage transformer for said microwave oven for generating a high voltage;

a magnetron for said microwave oven for generating microwaves, said magnetron being driven by said high voltage from said high voltage transformer; and a switch, said switch comprising:

a pair of terminal members positioned in spaced relation in said case for connection between an electrical power source and said high voltage transformer, and a conducting member provided in said door, said conducting member including a pair of ends located to a side of said door, said conducting member being connected electrically to said pair of terminal members when said ends of said conducting member respectively contact said pair of terminal members to provide electrical power from said electrical power source to said high voltage transformer.

2. The microwave oven as claimed in claim 1, further comprising:

a pair of latch hooks provided in said door; and a pair of catch openings provided in said case for respectively receiving said pair of latch hooks, said ends of said conducting member respectively contacting said pair of terminal members when said pair of latch hooks are respectively inserted into said pair of catch openings, and said ends of said conducting member being respectively provided at a corresponding end of said pair of latch hooks.

3. The microwave oven as claimed in claim 2, said switch further comprising:

a first switch, said first switch comprising said pair of terminal members and said conducting member, said first switch being respectively connected electrically to an alternating current (AC) power source as said electrical power source; and a second switch, said second switch comprising an additional pair of terminal members and an additional conducting member, said second switch being respectively connected electrically to a direct current (DC) power source as said electrical power source, each of said ends of said conducting member of said first switch being positioned at an end of a respective one of said pair of latch hooks for insertion into a respective one of said pair of catch openings, and each of said ends of said additional conducting member of said second switch being positioned at an end of a respective one of an additional pair of latch hooks for insertion into a respective one of an additional pair of catch openings.

4. The microwave oven as claimed in claim 1, further comprising:

means for converting a direct current, when said electrical power source is a direct current power source, into an alternating current for being provided to said high voltage transformer.

5. The microwave oven as claimed in claim 4, said means for converting comprising:

a commutator, said commutator including an outer circle side of said commutator;

a motor for rotating said commutator;

a pair of input brushes for applying said direct current, when said direct current is supplied from said direct current power source, to said commutator by said pair of input brushes respectively contacting the outer circle side of said commutator; and a pair of output brushes for providing said alternating current from said direct current, when said commutator rotates to convert said direct current to said alternating current, by said pair of output brushes respectively contacting the outer circle side of said commutator.

6. The microwave oven as claimed in claim 1, said switch flier comprising:

a first switch, said first switch comprising said pair of terminal members and said conducting member, said first switch being respectively connected electrically to an alternating current (AC) power source as said electrical power source; and a second switch, said second switch comprising an additional pair of terminal members and an additional conducting member, said second switch being respectively connected electrically to a direct current (DC) power source as said electrical power source.

7. An AC/DC type microwave oven, comprising:

a pair of terminal members positioned in spaced relation for being connected between a high voltage transformer for said AC/DC type microwave oven and one of an alternating current (AC) power source and a direct current (DC) power source; and a conducting member provided in a door of said AC/DC type microwave oven, said conducting member including a pair of ends, said conducting member being respectively connected electrically to said pair of terminal members when said ends of said conducting member respectively contact said pair of terminal members to provide electrical power from said one of said alternating current (AC) power source and said direct current (DC) power source to said AC/DC type microwave oven when said door is in a closed position.

8. The AC/DC type microwave oven as claimed in claim 7, further comprising:

a pair of latch hooks formed in said door of said AC/DC type microwave oven; and a pair of catch openings for respectively receiving said pair of latch hooks, said pair of catch openings being formed in a case of said AC/DC type microwave oven, said ends of said conducting member respectively contacting said pair of terminal members when said pair of latch hooks are inserted into said pair of catch openings, and said ends of said conducting member being respectively provided at a corresponding end of said pair of latch hooks.

9. The AC/DC type microwave oven as claimed in claim 8, further comprising:

a first switch, said first switch comprising said pair of terminal members and said conducting member, said first switch being respectively connected electrically to said alternating current (AC) power source; and a second switch, said second switch comprising an additional pair of terminal members and an additional conducting member, said second switch being respectively connected electrically to said direct current (DC) power source, each of said ends of said conducting member of said first switch being positioned at an end of a respective one of said pair of latch hooks for insertion into a respective one of said pair of catch openings, and each of said ends of said additional conducting member of said second switch being positioned at an end of a respective one of an additional pair of latch hooks for insertion into a respective one of an additional pair of catch openings.

10. The AC/DC type microwave oven as claimed in claim 7, further comprising:

a first switch, said first switch comprising said pair of terminal members and said conducting member, said first switch being respectively connected electrically to said alternating current (AC) power source; and a second switch, said second switch comprising an additional pair of terminal members and an additional conducting member, said second switch being respectively connected electrically to said direct current (DC) power source.

11. An AC/DC type apparatus, comprising:

a pair of terminal members positioned in spaced relation for being connected between a high voltage transformer for said AC/DC type apparatus and one of an alternating current (AC) power source and a direct current (DC) power source; and a conducting member provided in a door of said AC/DC type apparatus, said conducting member including a pair of ends, and said conducting member being respectively connected electrically to said pair of terminal members when said ends of said conducting member respectively contact said pair of terminal members to provide electrical power from said one of said alternating current (AC) power source and said direct current (DC) power source to said AC/DC type apparatus when said door is in a closed position.

12. The AC/DC type apparatus as claimed in claim 11, further comprising:

a pair of latch hooks formed in said door of said AC/DC type apparatus; and a pair of catch openings for respectively receiving said pair of latch hooks, said pair of catch openings being formed in a case of said AC/DC type apparatus, said ends of said conducting member respectively contacting said pair of terminal members when said pair of latch hooks are inserted into said pair of catch openings, and said ends of said conducting member being respectively provided at a corresponding end of said pair of latch hooks.

13. The AC/DC type apparatus is claimed in claim 12, further comprising:

a first switch comprising said pair of terminal members and said conducting member, said first switch being respectively connected electrically to said alternating current (AC) power source; and a second switch, said second switch comprising an additional pair of terminal members and an additional conducting member, said second switch being respectively connected electrically to said direct current (DC) power source, each of said ends of said conducting member of said first switch being positioned at an end of a respective one of said pair of said latch hooks for insertion into a respective one of said pair of catch openings, and each of said ends of said additional conducting member of said second switch being positioned at an end of a respective one of an additional pair of latch hooks for insertion into a respective one of an additional pair of catch openings.

14. The AC/DC type microwave oven as claimed in claim 11, further comprising:

a first switch comprising said pair of terminal members and said conducting member, said first switch being respectively connected electrically to said alternating current (AC) power source; and a second switch, said second switch comprising an additional pair of terminal members and an additional conducting member, said second switch being respectively connected electrically to said direct current (DC) power source.

15. A switch for electrically connecting an electrical power source to an apparatus, comprising:

a pair of terminal members positioned in spaced relation for being connected between a high voltage transformer for said apparatus and said electrical power source;

a conducting member provided in a door of said apparatus, said conducting member including a pair of ends, and said conducting member being respectively connected electrically to said pair of terminal members when said ends of said conducting member respectively contact said pair of terminal members to provide electrical power from said electrical power source to said apparatus when said door is in a closed position.

16. The switch as claimed in claim 15, further comprising:

a pair of latch hooks formed in said door of said apparatus; and a pair of catch openings for respectively receiving said pair of latch hooks, said pair of catch openings being formed in a case of said apparatus, said ends of said conducting member respectively contacting said pair of terminal members when said pair of latch hooks are inserted into said pair of catch openings, and said ends of said conducting member being respectively provided at a corresponding end of said pair of latch hooks.

17. The switch as claimed in claim 16, further comprising:

a first switch, said first switch comprising said pair of terminal members and said conducting member, said first switch being respectively connected electrically to an alternating current (AC) power source as said electrical power source; and a second switch, said second switch comprising an additional pair of terminal members and an additional conducting member, said second switch being respectively connected electrically to a direct current (DC) power source as said electrical power source, each of said ends of said conducting member of said first switch being positioned at an end of a respective one of said pair of latch hooks for insertion into a respective one of said pair of catch openings, and each of said ends of said additional conducting member of said second switch being positioned at an end of a respective one of an additional pair of latch hooks for insertion into a respective one of an additional pair of catch openings.

18. The switch as claimed in claim 15, further comprising:

a first switch, said first switch comprising said pair of terminal members and said conducting member, said first switch being respectively connected electrically to an alternating current (AC) power source as said electrical power source; and a second switch, said second switch comprising an additional pair of terminal members and an additional conducting member, said second switch being respectively connected electrically to a direct current (DC) power source as said electrical power source.

* * * * *